US011585018B2

(12) United States Patent
Chapman

(10) Patent No.: US 11,585,018 B2
(45) Date of Patent: Feb. 21, 2023

(54) FIBROUS WEBS HAVING ISOTROPIC STRUCTURE AND APPARATUS AND METHOD FOR MAKING SAME

(71) Applicant: DELSTAR TECHNOLOGIES, INC., Middletown, DE (US)

(72) Inventor: Rick L. Chapman, Greenville, NC (US)

(73) Assignee: DELSTAR TECHNOLOGIES, INC., Middletown, DE (US)

( * ) Notice: Subject to any disclaimer, the term of this patent is extended or adjusted under 35 U.S.C. 154(b) by 139 days.

(21) Appl. No.: 16/525,739

(22) Filed: Jul. 30, 2019

(65) Prior Publication Data

US 2020/0032438 A1 Jan. 30, 2020

Related U.S. Application Data

(60) Provisional application No. 62/711,760, filed on Jul. 30, 2018.

(51) Int. Cl.
*D01G 15/26* (2006.01)

(52) U.S. Cl.
CPC ..... *D01G 15/26* (2013.01)

(58) Field of Classification Search
CPC ..... D01G 15/02; D01G 15/04; D01G 15/10; D01G 15/12; D01G 15/14; D01G 15/16; D01G 15/18; D01G 15/20; D01G 15/22; D01G 15/24; D01G 15/26; D01G 15/46;
(Continued)

(56) References Cited

U.S. PATENT DOCUMENTS 4,615,080 A * 10/1986 Wirth ..... D01G 25/00 19/106 R
4,852,217 A * 8/1989 Bernhardt ..... D01G 15/04 19/106 R
(Continued)

FOREIGN PATENT DOCUMENTS

DE 19535876 A1 4/1997
EP 1900863 A1 3/2008
(Continued)

OTHER PUBLICATIONS

European Patent Office; Partial International Search Report and Written Opinion; International Application No. PCT/EP2019/070552; dated Oct. 30, 2019.

*Primary Examiner* — Shaun R Hurley
(74) *Attorney, Agent, or Firm* — Farber LLC

(57) ABSTRACT

A fiber web structure made of randomly oriented synthetic fibers, an apparatus for making the web structure and a method of making the web structure. The web is a dimensionally-disordered, aerodynamically-formed structure in which electrostatic and/or non-electrostatic fibers are arranged to create structured fiber webs. The method uses different size, crimp, length and shapes of fibers, among various characteristics, to create strength and other properties. An apparatus for making the web structure includes a randomizing cylinder that removes fibers from a main cylinder, and condensing cylinders. The fiber webs may be structured in layers and the layers may have fibers and/or additives placed in or between the layers for enhanced performance.

15 Claims, 11 Drawing Sheets

(58) Field of Classification Search
CPC ..... D01G 15/48; D01G 15/50; D01G 15/52; D01G 15/54
See application file for complete search history.

(56) References Cited

U.S. PATENT DOCUMENTS

| | | | | |
|---|---|---|---|---|
| 6,073,313 | A * | 6/2000 | Lasenga | D01G 15/04 19/106 R |
| 7,111,366 | B2 * | 9/2006 | Pinto | D01G 15/02 19/65 A |
| 7,152,278 | B2 * | 12/2006 | Bernhardt | D01G 15/04 19/98 |
| 7,735,201 | B1 * | 6/2010 | Reeves | D01G 15/88 19/114 |
| 9,663,877 | B2 * | 5/2017 | Zhang | D01G 15/88 |
| 2004/0154137 | A1 * | 8/2004 | Bauersachs | D01G 15/88 19/114 |
| 2004/0187267 | A1 * | 9/2004 | Brnhardt | D01G 15/20 19/98 |
| 2006/0026801 | A1 * | 2/2006 | Pinto | D04H 1/72 19/98 |
| 2007/0180660 | A1 * | 8/2007 | Saeger | D01G 15/18 19/98 |
| 2016/0348285 | A1 * | 12/2016 | Zhang | D01G 15/46 |

FOREIGN PATENT DOCUMENTS

| | | | |
|---|---|---|---|
| EP | 2660375 | A2 | 11/2013 |
| WO | WO199700984 | A1 | 1/1997 |
| WO | WO199713911 | A1 | 4/1997 |
| WO | WO2012052535 | A1 | 4/2012 |

* cited by examiner

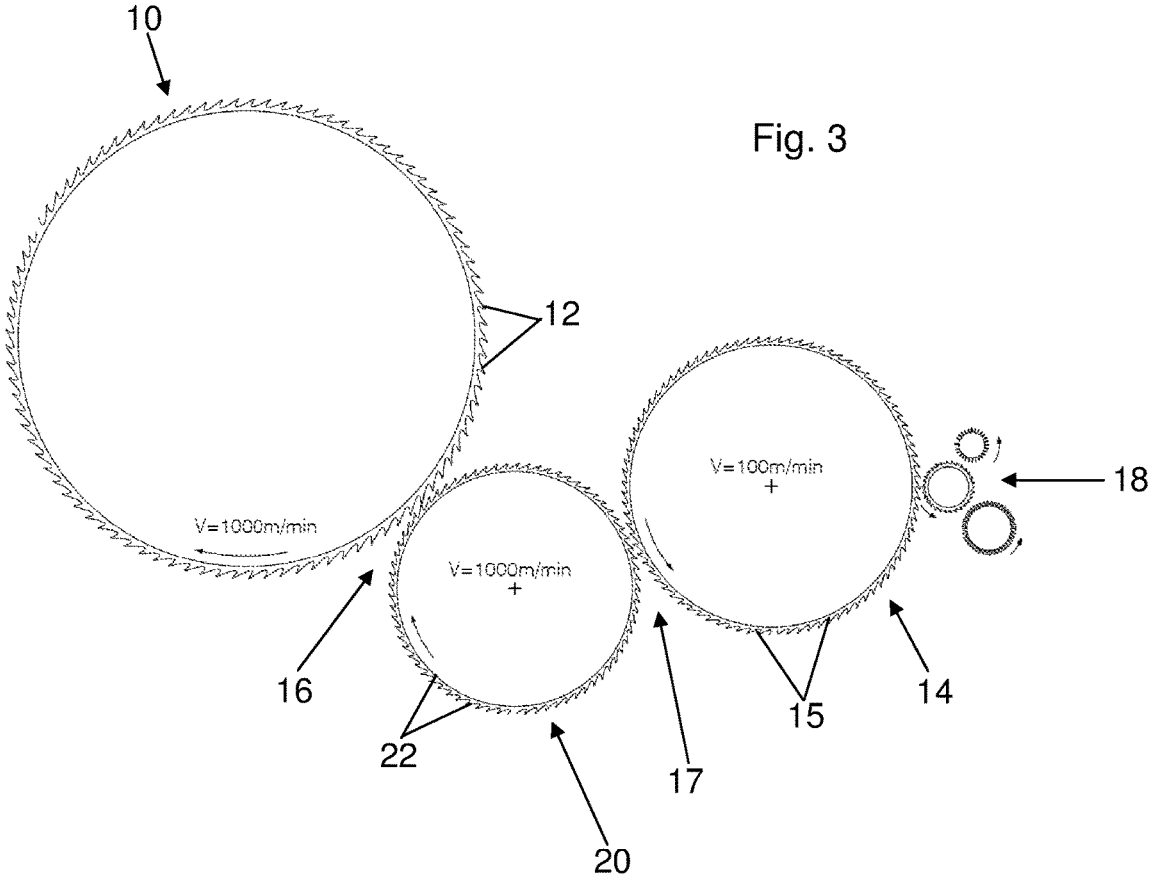
Fig. 3
Fig. 4
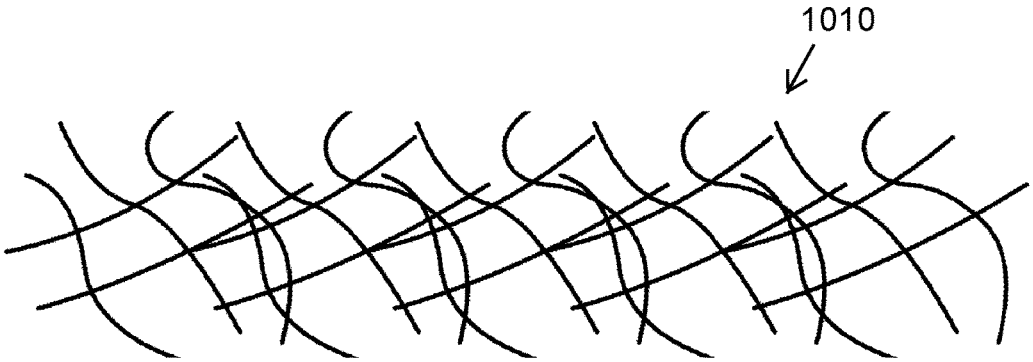

Fig. 5
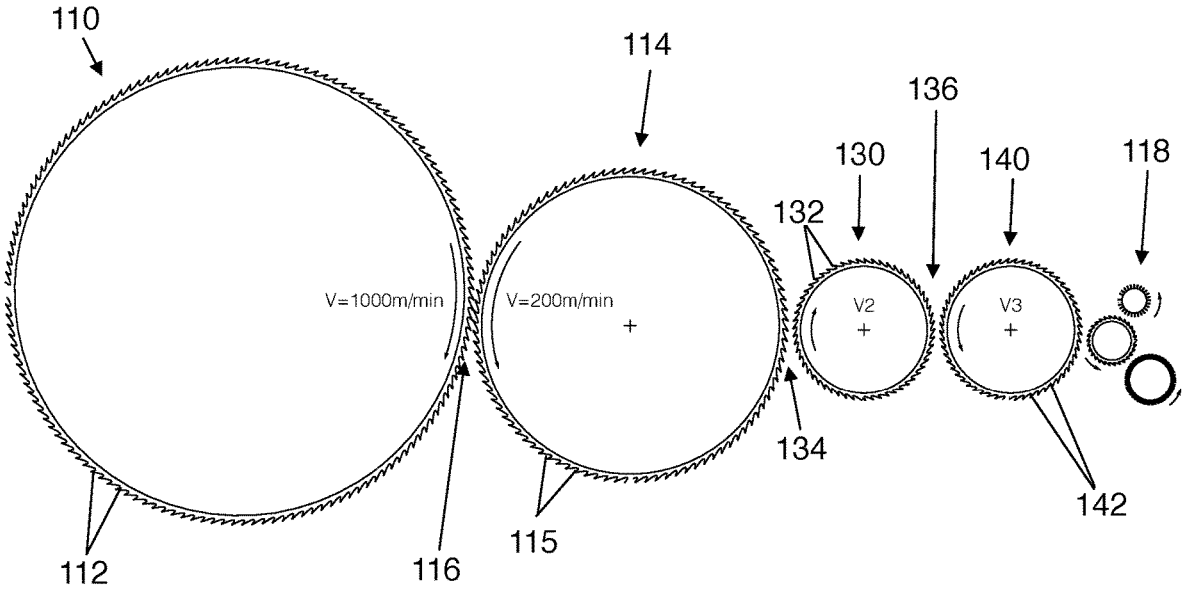
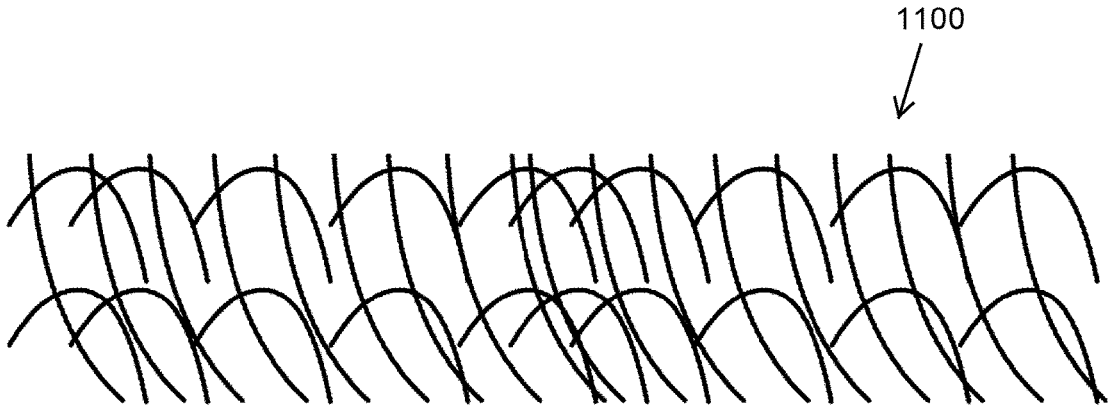
Fig. 6

| | Low | Regular | High |
|---|---|---|---|
| Crimps/cm | 3.6 | 5.8 | 7.6 |

| Fiber length (mm) | 38 | 51 | 64 | 76 |
|---|---|---|---|---|
| Sample denier 1 | 1-1.3 | 1.4-2.0 | 2.0-2.8 | 3.0-5.0 |
| Sample denier 2 | 0.7-1.3 | 1.4-2.0 | 2.0-2.8 | 3.0-5.0 |

FIBROUS WEBS HAVING ISOTROPIC STRUCTURE AND APPARATUS AND METHOD FOR MAKING SAME

CROSS-REFERENCE TO RELATED APPLICATIONS

This application claims benefit of U.S. Provisional Application No. 62/711,760, filed Jul. 30, 2018, and entitled "Fibrous Web Having Isotropic Structure and Mechanism and Method Thereto," the entire contents of which are incorporated by reference in its entirety.

FIELD

The disclosure relates generally to non-woven fiber webs used for gas filtration and methods and apparatuses for making such webs, and more particularly to methods and apparatuses for making non-woven fiber webs that are used for gas filtration and that have generally isotropic characteristics.

BACKGROUND

All non-woven fabrics are webs made up of multiple fibers in contact. In its finished state, a web's physical properties depend largely on the relative positioning of the fibers in the web, and this can include relative angles between fibers, fiber density (mass of fibers per unit volume) and other characteristics of the web.

Fiber webs can be manufactured by any number of methods, including, but not limited to, the air laid method, wet spinning, dry spinning and others. After the fibers are manufactured in a web, the web is commonly "carded" in order to disentangle, clean and/or intermix the manufactured fibers to produce a continuous web suitable for subsequent processing. The process of carding is well-known, and involves at least two surfaces, each of which has protruding pins, teeth or other similar structures moving relative to each other. The protrusions on the surfaces thus move relative to one another to "comb" the fibers in the direction of surface movement, otherwise referred to as "machine direction" (MD).

An example of a traditional carding mechanism is shown in FIG. 1. The FIG. 1 carding mechanism has a main cylinder 2 on which fibers are wound, and an adjacent doffer roll 4 that removes fibers from the main cylinder 2 while rotating in the opposite direction. A take-off roll 6 or other mechanism removes the fiber web from the doffer roll 4, and the entire mechanism produces webs 1000 in which fibers are oriented predominantly in the MD, as shown in FIG. 2, due to the combing action of the moving surfaces on which the fibers rest. The resulting anisotropic (i.e., directionally dependent) webs are largely undesirable for filtration purposes for the reasons described herein.

Finished web structures that contain electrostatic fibers are commonly formed, at least in part, by carding. Unfinished web structures containing electrostatic fibers are typically conveyed from the carding mechanism shown in FIG. 1 to a conventional lapper and then needled together. Alternatively, such unfinished web structures can be conveyed directly from a carding mechanism to a needle loom to be needled into the finished structure. In a finished structure produced by a carding mechanism followed by a needle loom, the fibers are oriented in the MD and form groups of two or more where the fibers run close together for considerable lengths. The spaces between the groups tend to blind off the electrostatic charged zones and these spaces become clogged with filtered particles. Each of the groups thus behaves as a single, wide, flat fiber with higher resistance to air flow than a plurality of properly spaced fibers that are ungrouped. Efficiency decreases because of the large gaps between these groups.

BRIEF SUMMARY

Disclosed herein is an apparatus for forming, along with a method of manufacturing, a fibrous web. The web preferably contains electrostatic fibers, but non-electrostatic fibers may be used. The fibers may be formed into an isotropic web that avoids the physical grouping problems of the prior art, and does not require subsequent processing, such as needling. It is an objective of the present disclosure to provide a dimensional, disordered (isotropic), aerodynamic web structure in which electrostatic fibers may be arranged to create desirably-structured fiber webs. As disclosed herein, the method creates a finished web structure in which the fibers are substantially randomly oriented (i.e., isotropic).

A final web structure is formed by using a modified carding apparatus and process, such as by adding to a main cylinder and a doffer one or more rotating cylinders with protrusions extending therefrom which may be radially-oriented in the manner of a conventional carding drum. There are preferably between one and four added cylinders rotating at speeds that may differ from one another, and from the conventional carding apparatus cylinders, to produce the web structures described herein in more detail. The speeds and rotational directions of the added cylinders differ from those of the existing technology to produce a superior product.

Generally, the fibrous web structure has a three-dimensional, structured fibrous matrix of non-woven fibers randomly oriented along an x, y, and z axis, the fibers being configured to intersect along their lengths throughout the matrix, and a plurality of interstitial openings between the fibers. The fibrous matrix provides a path for media to flow through the matrix in order to capture a first media and allow a second media to escape through the interstitial openings. The fibers may be interconnected along their lengths in the x, y, and z axes.

In accordance with an aspect of the disclosure, an apparatus for forming a web of non-woven fibers is provided. The apparatus may comprise: (a) a main cylinder having a peripheral cylindrical surface upon which a plurality of fibers is disposed, the main cylinder rotating in a first rotational direction; (b) a randomizing cylinder rotating in the first rotational direction and with a peripheral cylindrical surface adjacent the main cylinder's peripheral cylindrical surface; and (c) a doffer cylinder rotating in a second rotational direction that is opposite the first rotational direction, the doffer cylinder having a peripheral cylindrical surface adjacent the randomizing cylinder's peripheral cylindrical surface. The fibers may be synthetic fibers capable of maintaining an electrostatic charge. The peripheral cylindrical surfaces may extend across tips of protrusions that extend with a radial component from their respective cylinders (i.e., angled).

In some embodiments, the apparatus may include a first condensing cylinder rotating in the first rotational direction and having a peripheral cylindrical surface adjacent the doffer cylinder's peripheral cylindrical surface; and a second condensing cylinder rotating in the second rotational direction and having a peripheral cylindrical surface adjacent the first condensing cylinder's peripheral cylindrical surface. The apparatus may be suitable for forming a fibrous web wherein the fibers are synthetic fibers capable of maintaining an electrostatic charge.

In some embodiments, the apparatus may include a second randomizing cylinder rotating in the first rotational direction and with a peripheral cylindrical surface adjacent the main cylinder's peripheral cylindrical surface; a second doffer roll rotating in a second rotational direction that is opposite the first rotational direction, the doffer roll having a peripheral cylindrical surface adjacent the second randomizing cylinder's peripheral cylindrical surface; a third condensing cylinder rotating in the first rotational direction and having a peripheral cylindrical surface adjacent the second doffer roll's peripheral cylindrical surface; and a fourth condensing cylinder rotating in the second rotational direction and having a peripheral cylindrical surface adjacent the third condensing cylinder's peripheral cylindrical surface.

In accordance with another aspect of the disclosure, an apparatus for forming a web of non-woven fibers is provided. The apparatus may include a main cylinder having a peripheral cylindrical surface upon which a plurality of fibers is disposed, the main cylinder rotating in a first rotational direction; a doffer cylinder rotating in a second rotational direction that is opposite the first rotational direction, the doffer cylinder having a peripheral cylindrical surface adjacent the main cylinder's peripheral cylindrical surface; a first condensing cylinder rotating in the first rotational direction and having a peripheral cylindrical surface adjacent the doffer cylinder's peripheral cylindrical surface; and a second condensing cylinder rotating in the second rotational direction and having a peripheral cylindrical surface adjacent the first condensing cylinder's peripheral cylindrical surface. The fibers may be synthetic fibers capable of maintaining an electrostatic charge. The peripheral cylindrical surfaces may extend across tips of protrusions that extend with a radial component from their respective cylinders.

In accordance with still another aspect of the disclosure, a method for forming a web of non-woven fibers is provided. The method may comprise the steps of disposing a plurality of fibers on a peripheral cylindrical surface of a main cylinder, the main cylinder rotating in a first rotational direction; rotating a randomizing cylinder in the first rotational direction with a peripheral cylindrical surface adjacent the main cylinder's peripheral cylindrical surface, the randomizing cylinder's peripheral cylindrical surface removing at least some of said plurality of fibers from the main cylinder; and rotating a doffer cylinder in a second rotational direction, which is opposite the first rotational direction, with a peripheral cylindrical surface adjacent the randomizing cylinder's peripheral cylindrical surface, the doffer cylinder's peripheral cylindrical surface removing at least some of said plurality of fibers from the randomizing cylinder, and thereby forming the web of non-woven fibers having substantially isotropic orientation. A layer of micro fibers and/or nano fibers may be interposed between the layers. Additionally, additives may be applied to at least one of the layers.

In yet another embodiment, the method may further comprise the steps of rotating a first condensing cylinder in the first rotational direction with a peripheral cylindrical surface adjacent the doffer cylinder's peripheral cylindrical surface, the first condensing cylinder's peripheral cylindrical surface removing at least some of said plurality of fibers from the doffer cylinder; and rotating a second condensing cylinder in the second rotational direction with a peripheral cylindrical surface adjacent the first condensing cylinder's peripheral cylindrical surface, the second condensing cylinder's peripheral cylindrical surface removing at least some of said plurality of fibers from the first condensing cylinder. A layer of micro fibers and/or nano fibers may be interposed between the layers. Additionally, additives may be applied to at least one of the layers.

In accordance with yet another aspect of the disclosure, a method for forming a web of non-woven fibers is provided. The method may comprise the steps of disposing a plurality of fibers on a main cylinder having a peripheral cylindrical surface, the main cylinder rotating in a first rotational direction; rotating a doffer cylinder in a second rotational direction that is opposite the first rotational direction, the doffer cylinder having a peripheral cylindrical surface adjacent the main cylinder's peripheral cylindrical surface, the doffer cylinder's peripheral cylindrical surface removing at least some of said plurality of fibers from the main cylinder; rotating a first condensing cylinder in the first rotational direction with a peripheral cylindrical surface adjacent the doffer cylinder's peripheral cylindrical surface, the first condensing cylinder's peripheral cylindrical surface removing at least some of said plurality of fibers from the doffer cylinder; and rotating a second condensing cylinder in the second rotational direction with a peripheral cylindrical surface adjacent the first condensing cylinder's peripheral cylindrical surface, the second condensing cylinder's peripheral cylindrical surface removing at least some of said plurality of fibers from the first condensing cylinder. A layer of micro fibers and/or nano fibers may be interposed between the layers. Additionally, additives may be applied to at least one of the layers.

Other aspects and advantages of the disclosure will become apparent from the following description, taken in conjunction with the accompanying drawings, by way of example of the principles of the disclosure.

BRIEF DESCRIPTION OF THE DRAWINGS

FIG. 3 is a schematic side view illustrating an apparatus for making a fibrous web in accordance with the present disclosure.

FIG. 4 is a schematic side view illustrating a web of fibers after removal from the apparatus of FIG. 3 on which the fibers have been reoriented to be substantially isotropic.

FIG. 5 is a schematic side view illustrating an apparatus for making a fibrous web in accordance with the present disclosure.

FIG. 6 is a schematic side view illustrating a web of fibers after removal from the apparatus of FIG. 5.

Figure 1:
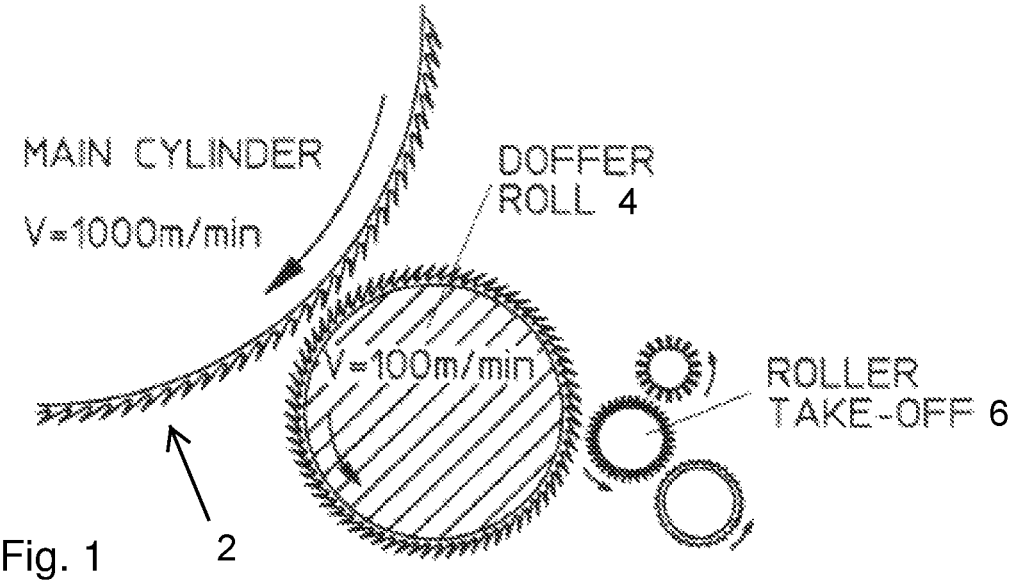
Fig. 1 (Prior art)
FIG. 1 is a schematic side view illustrating a prior art carding machine.

In describing the preferred embodiments of the disclosure which are illustrated in the drawings, specific terminology will be resorted to for the sake of clarity. However, it is not intended that the disclosure be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION

Figure 2:
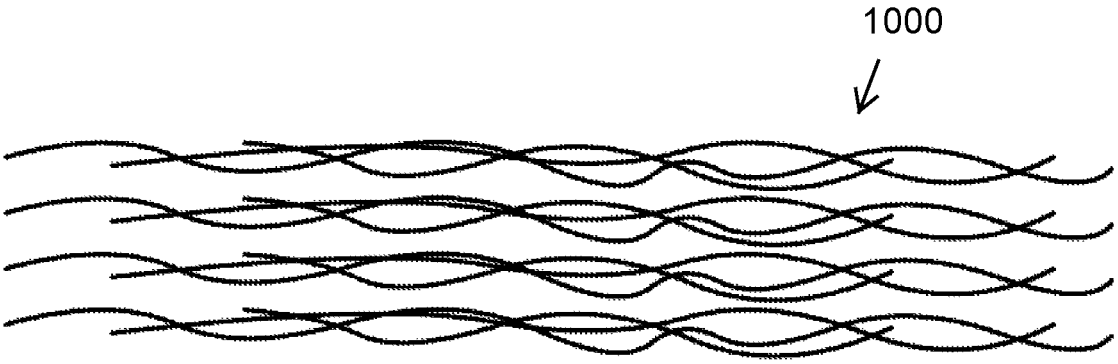
Fig. 2 (Prior art)
FIG. 2 is a schematic side view illustrating a web of fibers after removal from the prior art carding machine shown in FIG. 1.

The exemplary embodiments of the present disclosure may operate in conjunction with a conventional carding apparatus, an example of which is shown in FIG. 1, for making a conventional fibrous web 1000, as shown in FIG. 2. This conventional apparatus may be used with various types of fibers, and the invention may also be used with any type of conventional fiber. A person of ordinary skill will be aware of how to adapt the exemplary embodiments of the disclosure to new fiber types and because fiber materials, manufacturing processes, and other characteristics can vary, new fibers may be useable with the disclosure. As an example of an acceptable fiber, synthetic electrostatic fibers of the type described herein are contemplated for use with the invention. Electrostatic fibers are those fibers that can retain an electrostatic charge, and includes electrets. The contemplated fibers can be manufactured by any method, including, without limitation, the air laid method, spinneret, gel spinning, melt spinning, wet spinning, dry spinning and others. The fibers may be charged by corona charging, hydro-entanglement and/or tribo-electrification. Non-electrostatic fibers may also or alternatively be used. The fibers contemplated may have many shapes in cross-section, including without limitation, circular, kidney bean, dog bone, trilobal, barbell, bowtie, star, Y-shaped and others. These shapes and/or other conventional shapes may be used with the embodiments of the present disclosure to obtain the desired performance characteristics, and any shape can be used with electrostatic and/or mechanical (non-electrostatic straining) filtration media. Polymers of which the fibers are made may include, without limitation, acrylic, polyester, polypropylene, polyethylene, nylon, polyamide, HDPE, styrene, any super-absorbent and cellulose. Other conventional fiber materials are contemplated. The fibers in the media may stay connected to other fibers by being thermally-bonded, chemically-bonded or entangled with one another. Bicomponent (so-called "bico") fibers may be used, particularly with mechanical filtration, and these are formed by extruding two polymers from the same spinneret with both polymers contained within the same filament. The following polymers may be used as either of the components in the bico fibers, as can any of the polymers listed herein: PET (polyester), PEN polyester; nylon; PCT polyester; polypropylene; PBT polyester; co-polyamides; polylactic acid; polystyrene; acetal; polyurethane; soluble co-polyester; HDPE and LLDPE.

In the apparatus of FIG. 3, there is a main cylinder 10, which has many protrusions 12 (referred to conventionally as "teeth") that extend with a radial component away from the axis of rotation of the main cylinder 10. The protrusions 12 may be angled toward the direction of rotation of the main cylinder 10 so that the moving tips thereof contact an intersecting web at an angle different from 90 degrees (the angle of a radially-oriented pin or protrusion), and with the pointed tip at an acute angle and pointed into the web. For example, the angle of each protrusion 12 can be between about 30 and about 60 degrees from radial, and more preferably between about 40 and about 50 degrees from radial, and most preferably about 45 degrees from radial. This configuration is preferred, but other configurations are contemplated. Unless noted otherwise, all protrusions described herein have characteristics, ranges and features similar to those of the protrusions 12 described above.

The cylinders, such as the main cylinder 10, may be described as having a peripheral cylindrical surface, and this surface may be continuous around the cylinder. However, this surface may also be discontinuous, and may be defined by the tips of the protrusions 12 that extend with a radial component from the cylinder at discrete points. Thus, the peripheral cylindrical surface of a cylinder that has protrusions extending from the surface thereof may be the surface that is formed by the tips of the protrusions.

The main cylinder 10 may rotate in a clockwise direction in the illustration of FIG. 3, as noted by the arrow. Of course, this rotation may be reversed if changes known to a person of ordinary skill are made. In the configuration of FIG. 3, a doffing cylinder 14 (also referred to herein as a "doffer roll", "doffing roll", "doffer" or similar) may rotate in a counter-clockwise direction, as noted by the arrow, at a much slower speed than the main cylinder 10, such as at about ten percent of the main cylinder's 10 speed. As an example, the speed of the main cylinder's outer surface can be about 1000 meters per minute, and the speed of the outer surface of the doffing cylinder 14 can be 100 meters per minute. All of the speeds discussed herein are surface speeds, unless noted otherwise. The doffing cylinder 14 functions in much the same manner as a conventional doffer and therefore any speeds at which conventional doffers rotate relative to a main cylinder are contemplated. There are protrusions 15 formed on the doffer 14, and these are similar to the protrusions 12.

Interposed between the main cylinder 10 and the doffer 14 is a random roll 20 (or "randomizing cylinder") that may rotate in a clockwise direction in the illustration of FIG. 3, as noted by the arrow illustrated on the random roll 20. This is the same direction as the main cylinder 10. The random roll 20 may be about one-half the diameter of the main cylinder 10, but this is not critical. There are protrusions 22 formed on the random roll 20, and these are similar to the protrusions 12. In the embodiment of FIG. 3, the protrusions 22 on the random roll 20 are angled toward the direction of rotation of the random roll 20 within a range of angles similar to the protrusions 12 of the main cylinder 10, so that the protrusions 22 strike the web on the main cylinder 10 with their pointed tips at an acute angle to radial and pointed into the web.

The random roll 20 and the main cylinder 10 may rotate in the same direction, which may be counterclockwise in the illustration. Thus, when main cylinder 10 and the random roll 20 are aligned with their axes of rotation parallel and offset a distance slightly greater than the sum of the radii of the two cylinders, the closest surfaces are the tips of their respective protrusions 12 and 22. These closest surfaces move in opposite directions relative to one another on opposite sides of a gap 16 formed therebetween. In a preferred embodiment, the random roll 20 rotates at about the same speed as the main cylinder 10, but, as noted, with its closest surface moving in a direction opposite to the closest surface of the main cylinder 10.

The doffer 14 removes fibers from the random roll 20 in the form of a fiber web (not shown) at the gap 17 after the fibers are removed from the main cylinder 10 by the random roll 20. This web is collected on the slower-moving doffer 14 as the closest surface of the doffer 14 moves in the same direction as the closest surface of the random roll 20 at the gap 17. The doffer 14 then conveys the web beneath the doffer 14 in the orientation of FIG. 3 to the takeoff rolls 18 where the web is removed from the doffer 14. The fiber web that is removed from the doffer 14 may have the appearance of the fibers in FIG. 4.

The doffer 14 and the takeoff rolls 18 shown in FIG. 3 are similar to structures found in the conventional apparatus of FIG. 1 and may operate conventionally to produce a continuous web of woven fibers that is subsequently used for any conventional purpose, such as in air filtration. As an example, electrostatic fibers may be placed on the main cylinder 10 shown in FIG. 3, processed as described herein, and then removed, cut into rectangular batts, placed in frames and used as conventional residential and/or commercial and/or industrial HVAC filters. Of course, other uses can be made of the web, and this is just one example.

The random roll 20 may be smaller in diameter than the main cylinder 10 to which it is adjacent, and may rotate in the same direction as the main cylinder 10 as explained above. The relative surface speeds of the random roll 20 and the main cylinder 10 may be substantially equal, or they may be different but of the same order of magnitude. The speed of the random roll 20 may vary from about one-tenth of the speed of the main cylinder 10 to about ten times the speed of the main cylinder 10. In one example, the relative speed of the random roll 20 at the closest point of proximity with the surface of the main cylinder 10, which is the transfer point for the fiber web, may be twice the speed of the main cylinder 10. In another example, the random roll 20 may move at one-half the speed of the main cylinder 10. In another example, both are rotating at a speed of about 1000 meters per minute. Variations in relative speeds from that described may vary the structure of the resulting webs from that shown and described, as will become apparent to a person of ordinary skill from the description herein.

The protrusions 22 of the random roll 20 and the protrusions 12 of the main cylinder 10 may not touch one another at the gap 16 or elsewhere. The angles of inclination of the random roll's 20 protrusions 22 are preferably in the direction shown, which results in a direction change at the transition point at the gap 16, as discussed above. The protrusions 22 are disposed at angles similar to those of the protrusions 12 of the main cylinder 10 as described above but in the opposite direction in the gap 16. A nearly complete transfer of fibers from the main cylinder 10 to the random roll 20 occurs at the transition point, as may be expected in stripping, and as is described next.

In accordance with the present disclosure, an "aerodynamic whirlwind" area may be created by the apparatus shown in FIG. 3 at the gap 16, which is the transfer point between the main cylinder 10 and the "randomizing device" formed by the random roll 20. The randomizing device thus causes a great deal of disorder in the fibers of the finished web. At the transition point of the gap 16 an aerodynamic whirlwind area causes the resulting web 1010 (shown schematically in FIG. 4 from the side with thickness of the web in the top-to-bottom direction) to be far more isotropic than a conventional web (shown in FIG. 2) resulting from the conventional carding apparatus of FIG. 1. The fibers in the web 1010 of FIG. 4 are not mainly oriented in the machine direction (MD), but are oriented substantially transverse to the MD. Some fibers have most of their lengths oriented at least about 45 degrees from the MD, and portions of others have most of their lengths close to 90 degrees from the MD.

The mechanism of transfer in the gap 16 is understood to be aerodynamic, and during the transfer there is a substantial reorientation of the fibers away from the MD and toward an overall more isotropic orientation. This is an important step in the process of creating a structured, highly isotropic fiber web. Many of the electrostatic fibers, which are fully charged at the point of the transition, stand up perpendicular to the plane of the web in the moment of transfer due to the charge of fibers around them, mechanical forces applied to them, inertia, centrifugal force, and other reasons that may not be fully understood. Non-electrostatic fibers stay relatively flat during the transition in the gap 16.

After the transfer of the fibers across the gap 16 to the random roll 20, the upright fibers in the web lay down in all lateral directions, not just in the machine direction, as the fibers are conveyed by the random roll 20 toward the doffer 14. A gap 17 is formed between the doffer 14 and the random roll 20. The doffer 14 may have a surface speed much slower than the random roll 20 and may rotate oppositely to the random roll 20. The fiber web is removed from the random roll 20 by the doffer 14, and then the fiber web is removed by the takeoff rolls 18.

The web with the structure shown schematically in FIG. 4 may be processed as desired after being removed from the doffer 14 by the takeoff rolls 18. The fibers in the web are transverse to the MD, which may form angles of 30°, 45°, 60°, 90° and others relative to the MD, causing the web to have a much more isotropic configuration as shown schematically in FIG. 4. Fiber size, the lengths of the fibers, crimp frequency and amplitude, and fiber shape affect the complex, three dimensional random geometric structured layer of the web. Thus, the transition from the main cylinder 10 to the random roll 20 is influenced by the characteristics of the fibers, and the FIG. 4 web is but one example of a resulting fiber web.

Another embodiment of an apparatus is shown in FIG. 5 with a main cylinder 110 adjacent to which a doffer 114 rotates. The doffer 114 may rotate in the opposite direction from the main cylinder 110 and at a slower speed in a conventional manner. The main cylinder 110 may rotate clockwise, and the doffer may rotate counter-clockwise, in the configuration shown in FIG. 5 as noted by the respective arrows. The doffer's 114 orientation and direction of movement result in the surfaces of the main cylinder 110 and doffer 114 moving in the same relative direction at their closest point, which is in the gap 116.

The doffer 114 removes fibers from the main cylinder 110 in the form of a fiber web at the gap 116 in a conventional manner, and this web (not shown but which may resemble the web of FIG. 2) is conveyed beneath the doffer 114 in the orientation of FIG. 5 to the first condensing cylinder 130 at the gap 134. The transition of the fiber web in the gap 116 is conventional, and the fiber web that is removed from the doffer 114 is similarly conventional, and may have the appearance of the fibers in FIG. 2.

The fiber web is removed from the doffer 114 by the condensing cylinder 130 at the gap 134. The gap 134 is shown in FIG. 5 in an exaggerated size for illustrative purposes, and may be in the range of about 6 to about 12 thousandths of an inch. The condensing cylinder 130 may rotate in the opposite direction relative to the doffer 114, which may be clockwise in the configuration of FIG. 5, and at a slower speed than the doffer 114. Thus the outer surfaces thereof move in the same direction at the gap 134. The slower speed of the condensing cylinder 130 may be about 2 to about 20 percent slower than the doffer 114 at their respective outer surfaces at the gap 134. The fiber web is thus removed from the doffer 114 by the condensing cylinder 130, and the web is conveyed above (in the orientation of FIG. 5) the condensing cylinder 130 to the gap 136 between the condensing cylinders 130 and 140.

There are protrusions 112 on the main cylinder 110 that are similar to the protrusions 12 on the main cylinder 10 of FIG. 3, extending in the same direction relative to rotation, and having a similar angle relative to radial. There are protrusions 115 on the doffer 114 that are similar to the protrusions 15 of the doffer 14, which may rotate counter-clockwise in the orientation of FIG. 5. There are protrusions 132 and 142 on the condensing cylinders 130 and 140, respectively, which are similar to the protrusions 12 described above. However, the protrusions 132 and 142 are angled away from the rotational directions of the condensing cylinders 130 and 140. Thus, the protrusions 132 strike the web on the doffer 114 with their pointed tips at an acute angle to a radial of the condensing cylinder 130, and pointed away from the web. The protrusions 142 strike the web on the condensing cylinder 140 with their pointed tips at an acute angle to a radial of the condensing cylinder 140, and pointed away from the web.

The condensing cylinders 130 and 140 may rotate in directions opposite to one another, which causes their closest surfaces to move in the same relative direction at the gap 136. Thus, when the web comes over the top of the condensing cylinder 130 and continues downwardly (in the orientation of FIG. 5) into the gap 136, the web can be compressed, depending upon the distance between the outer surfaces of the condensing cylinders 130 and 140 in the gap 136. With the gap 136 of space equal to the thickness of the fiber web, the fiber web may be merely received in the gap 136, and not compressed substantially. The distance of the gap 136 may be in the range of 5 to 25 thousandths of an inch for a conventional web, but may be modified for webs of different thicknesses, as will become apparent to the person of ordinary skill.

There may be a difference between the speed of the outer surfaces of the condensing cylinders 130 and 140, which difference may cause the protrusions 132 and 142 to modify the orientation of the fibers of the finished web to that shown schematically in FIG. 6. The condensing cylinder 140 may go slower than the condensing cylinder 130, the condensing cylinder 130 may go slower than the condensing cylinder 140, or the condensing cylinders 130 and 140 may move at about the same speed. The surface speed of the condensing cylinder 130 may be between about 2 and about 20 percent slower than the surface speed of the condensing cylinder 140. Alternatively, the surface speed of the condensing cylinder 140 may be about 2 to about 20 percent slower than the surface speed of the condensing cylinder 130.

The fiber web removed from the condensing cylinder 130 is modified in the gap 136 when there are differences in the surface speeds of the condensing cylinders 130 and 140. The modification from the fibers being oriented mostly in the machine direction (MD—see FIG. 2) to the more isotropic configuration shown in FIG. 6 is due to the effect the condensing cylinders 130 and 140 have on the fibers as the web passes through the gap 136. As the web passes between the condensing cylinders 130 and 140, the faster cylinder 130 tends to propel that portion of the web that it contacts faster than that portion of the web contacted by the slower cylinder 140. The protrusions 132 on the faster cylinder 130 are pointed away from the web as the protrusions 132 are rotated into the web on the doffer 114 at the gap 134. As the web is subsequently propelled by the cylinder 130, the protrusions 142 on the slower condensing cylinder 140 are directed into that portion of the web that is propelled by the faster condensing cylinder 130, and the protrusions 142 thereby modify the machine-direction-orientated fibers (when on the doffer 114) to a more isotropic orientation as shown in FIG. 6 as the web is removed by the takeoff rolls 118. This modification may be due to the protrusions 132 and 142 of both cylinders 130 and 140 bending the fibers of the web from the MD to the configuration shown in FIG. 6. Rather than being parallel to the MD, many of the fibers in the web 1100 of FIG. 6 become transverse, and even perpendicular, to the machine direction, and other fibers become oriented transverse, but less than perpendicular, to the machine direction. The configuration of the web 1100 of FIG. 6 provides substantial advantages compared to the MD fibers shown in FIG. 2. After being removed by the conventional takeoff rolls 118 the fiber web 1100 may be used in a desired manner, such as in a filtration frame.

The advantage of the apparatus of the FIG. 5 embodiment is that the fibers taken off of the main cylinder 110 by the doffer 114 are subsequently modified from their MD orientation on the doffer 114 when they are upstream of the gap 136. The fiber web is modified to the condensed form shown schematically in FIG. 6 after passing through the gap 136. One will notice that the fiber web 1100 in FIG. 6 has a greater thickness than the fibers of FIG. 2, and also that the orientation of the fibers is much more isotropic than those shown in FIG. 2. In particular, the fibers in the FIG. 6 web are not all mainly oriented in the machine direction (MD), but are transverse to the MD. This creates improvements when the web is used in filtration devices, but also in other uses, including without limitation, fillers and composites.

Although the condensing cylinders 130 and 140 are shown of similar size to one another in FIG. 5, the condensing cylinders 130 and 140 can be different sizes. The condensing cylinder 130 may be about 22 inches in diameter, the doffer 114 may be about 60 inches in diameter, and the condensing cylinder 140 may be about 22 inches in diameter. In some embodiments, the condensing cylinder 130 may be about 22 inches in diameter and the condensing cylinder 140 may be about 17 inches in diameter.

Figure 7:
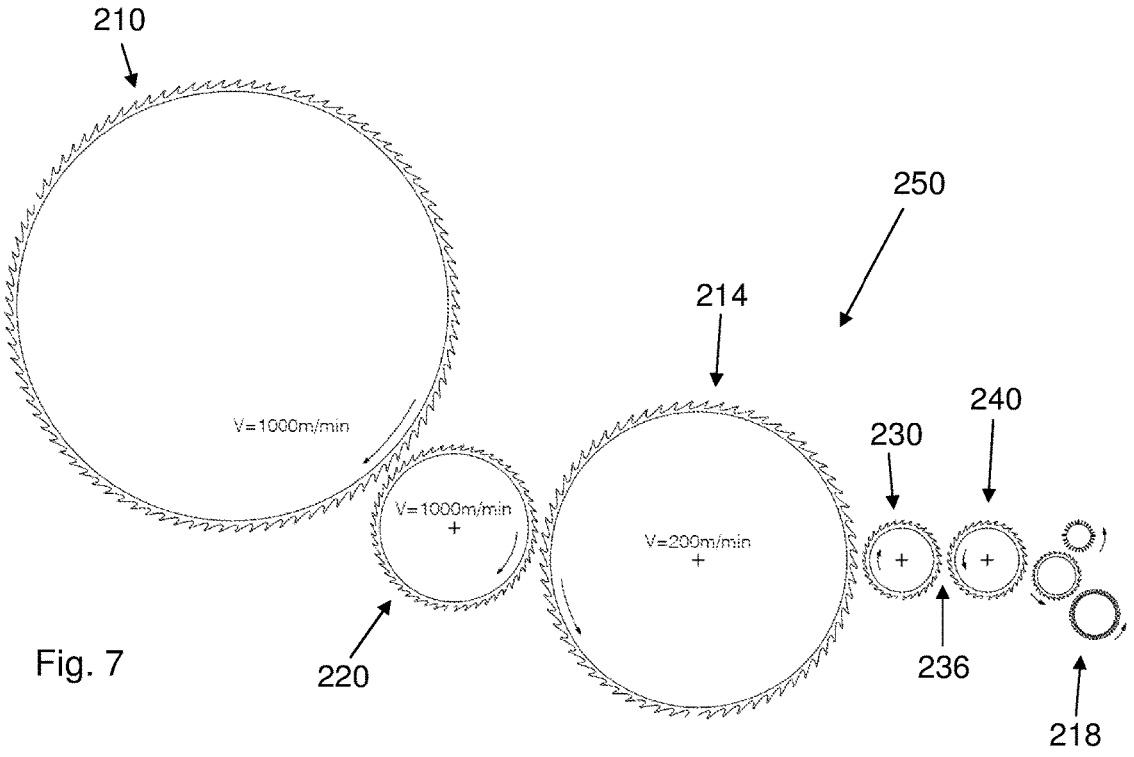
FIG. 7 is a schematic side view illustrating an apparatus for making a fibrous web in accordance with the present disclosure.
Figure 8:
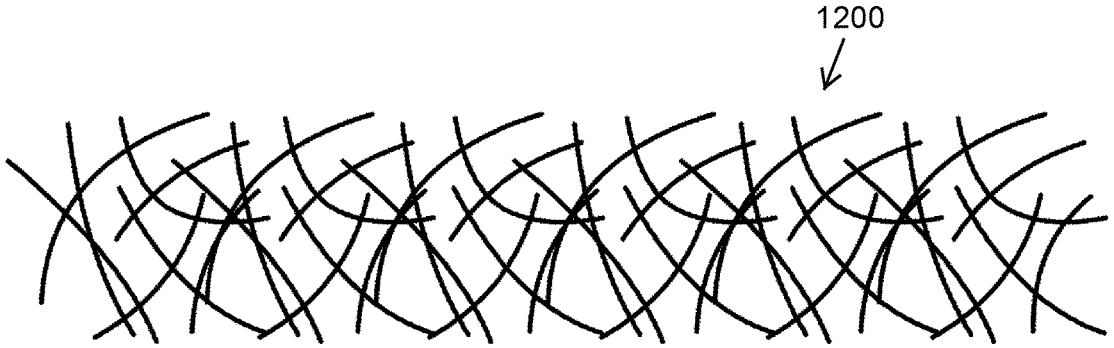
FIG. 8 is a schematic plan view illustrating a web of fibers after removal from the apparatus of FIG. 7.

Another embodiment of an apparatus of the present disclosure is illustrated in FIG. 7, in which a main cylinder 210, a randomizing roll 220, a doffer 214 and first and second condensing cylinders 230 and 240 are configured to work together. The apparatus 250 operates by combining the structural features of the embodiments of FIGS. 3 and 5. For example, the random roll 220 has an effect on a web of fibers being removed from the main cylinder 210 that is similar to the effect of the random roll 20 in the FIG. 3 embodiment. The doffer 214 removes the fiber web (which may have the appearance of the web shown in FIG. 4) from the random roll 220, similarly to the FIG. 3 embodiment. The doffer 214 may then convey the web to the condensing cylinders 230 and 240, which function in much the same manner as the condensing cylinders 130 and 140 shown in the FIG. 5 embodiment and described above in relation thereto. The condensing cylinder 230 removes the fiber web from the doffer 214 and passes the web to the gap 236. The fiber web is modified by passing through the gap 236, as the web is modified as described above as it passes through the gap 136, and is then removed from the condensing cylinder 240 by the conventional takeoff rolls 218. All cylinders in the apparatus of the FIG. 7 embodiment have protrusions similar to those described in relation to the FIGS. 3 and 5 embodiments of apparatuses, and rotate in relative directions shown by arrows. Because the web has been processed by both the randomizer 220 and the condensing cylinders 230 and 240 by the time it is removed by the takeoff apparatus 218, the fibers in the web are oriented highly isotropically as shown in FIG. 8. The web may then be used as described above.

The apparatus of the FIG. 7 embodiment thus obtains the advantages of the FIGS. 3 and 5 embodiments, and combines them in a continuous series of cylinders to form the web during processing in a continuous series of steps. The fiber web 1200 shown schematically in FIG. 8 contains fibers that are more randomly oriented than the webs resulting from either the apparatuses of the FIG. 3 or the FIG. 5 embodiments alone.

In all contemplated embodiments of the present disclosure, the characteristics of the web can be modified by various factors. Such factors include, but are not limited to, fiber length, fiber diameter, fiber shape and fiber crimp (in-plane orientation), denier, the way fibers are deposited on top of each other, and the fiber web structure. These factors significantly affect the properties of a fiber web made according to the disclosure. The length of a fiber passing through the rotating cylinders has a major effect on the geometry of a fiber web structure. The web's characteristics may depend on the web geometry, which is affected by the mode of web formation. Web geometry is determined by the predominant fiber direction, whether uniformly-oriented (anisotropic) or randomly-oriented (isotropic), fiber shapes, the extent of inter-fiber engagement and/or entanglement, crimp, and Z-direction (along the thickness of the web) compaction. Web characteristics are also influenced by web weight and chemical and mechanical properties of the polymer that the fibers are made of.

Figures 23, 24, 25:
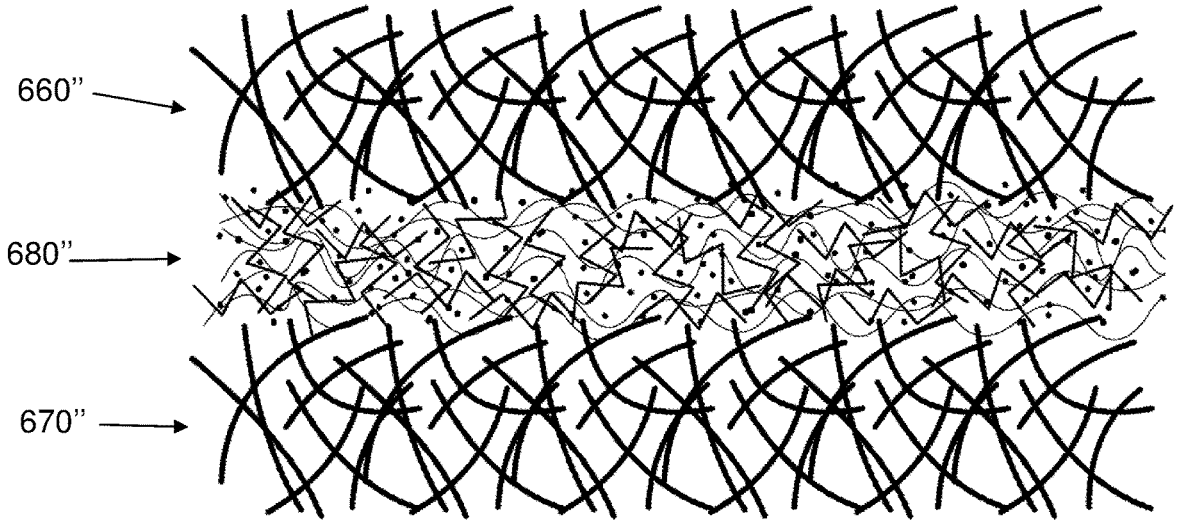
FIG. 23 is a schematic plan view illustrating another multilayer web of fibers.
FIG. 24 is a table illustrating low, regular and high levels of crimp per unit length of fibers contemplated.
FIG. 25 is a table illustrating sample denier ranges for given fiber lengths.

It should be noted that the crimp form of some textile fibers is essentially three-dimensional. Measurements needed for determination of these parameters are tedious and impractical to obtain by manual methods. Low, regular and high levels of crimp appear in the table of FIG. 24, which includes examples of the number of crimps per unit length of fibers. Some examples of fiber deniers contemplated include 3 to 5, 2.8 to 1.7 and 1.5 to 1.0, and examples of denier ranges for sample fiber lengths are shown in the table of FIG. 25. For electrostatic fibers, which include at least polypropylene and acrylic, the ranges of denier contemplated are 1.7 to 2.8 (for polypropylene) and 1.3 to 3.0 (acrylic), which fibers may be used alone or in combination with one another. For mechanical filtration fibers, bicomponent fibers are contemplated in a range of 2 to 12 denier and those fibers are used without electrostatic fibers.

Figure 9:
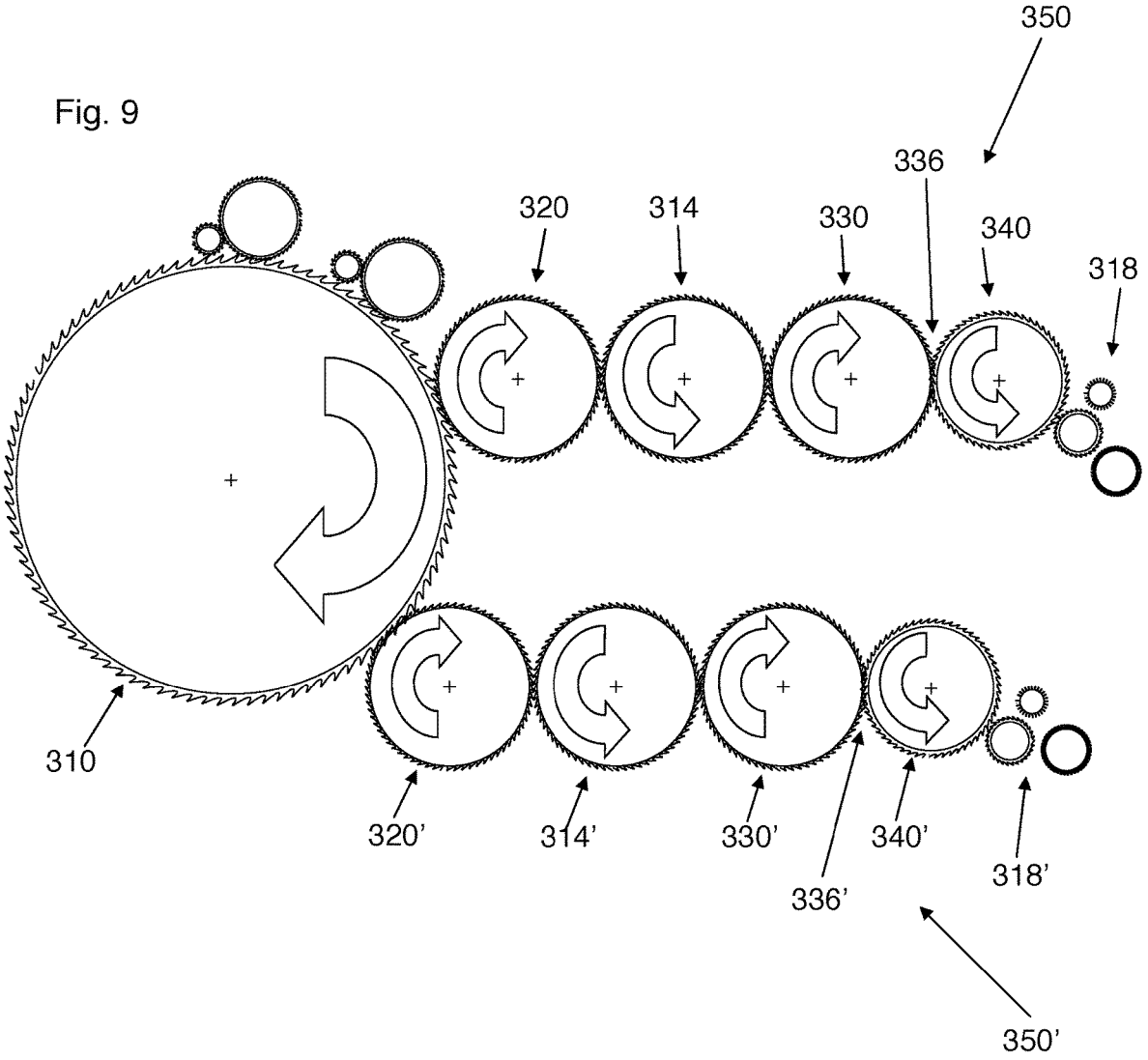
FIG. 9 is a schematic side view illustrating an apparatus for making a fibrous web in accordance with the present disclosure.

Another embodiment of an apparatus of the present disclosure is illustrated in FIG. 9, in which a main cylinder 310, a random roll 320, a doffer 314 and first and second condensing cylinders 330 and 340 are configured to work together with takeoff rolls 318. The apparatus 350, which is made up of the foregoing components (apart from the main cylinder 310), operates similarly to the apparatus 250 shown in FIG. 7, and has structures that are similar to the apparatus 250 described above. The random roll 320 has an effect on a web of fibers being removed from the main cylinder 310 that is similar to the effect of the random roll 220 in the FIG. 7 embodiment. The doffer 314 removes the fiber web (which has the appearance of the web shown in FIG. 4) from the random roll 320, similarly to the FIG. 7 embodiment, and then conveys the web to the condensing cylinders 330 and 340, which function in much the same manner as the condensing cylinders 230 and 240 shown in the FIG. 7 embodiment and described above in relation thereto. The fiber web is modified by passing through the gap 336, similarly to how the web is described above as being modified by passing through the gap 236, and is then removed from the condensing cylinder 340 by the conventional takeoff rolls 318.

All cylinders in the apparatus of the FIG. 9 embodiment have protrusions similar to those described in the embodiments above, and all rotate as shown by their respective arrows. Because the fiber web coming from the apparatus 350 has been processed by both the random roll 320 and the condensing cylinders 330 and 340 by the time it is removed by the takeoff rolls 318, the fibers in the resulting web are oriented highly isotropically similarly to the web shown in FIG. 8.

The apparatuses of the FIG. 9 embodiment includes a second apparatus 350' that operates in association with the main cylinder 310. Similarly to the apparatus 350 described above, a random roll 320', a doffer 314' and first and second condensing cylinders 330' and 340' are configured to work together with takeoff rolls 318'. The apparatus 350', which is made up of the foregoing components, has structures that are similar to the apparatus 350, and operates similarly to the apparatus 350. Thus, the random roll 320' has an effect on a web of fibers being removed from the main cylinder 310 that is similar to the effect of the random roll 220 in the apparatus of the FIG. 7 embodiment. The doffer 314' removes the fiber web (which has the appearance of the web shown in FIG. 4) from the random roll 320', similarly to the FIG. 7 embodiment, and then conveys the web to the condensing cylinders 330' and 340', which function in much the same manner as the condensing cylinders 230 and 240 shown in the FIG. 7 embodiment and described above in relation thereto. The fiber web is modified by passing through the gap 336', similarly to the way the web is described above as being modified by passing through the gap 236, and is then removed from the condensing cylinder 340' by the conventional takeoff rolls 318'. All cylinders in the apparatus 350' have protrusions similar to those described in relation to the embodiments above, and all rotate as shown by the respective arrows. Because the fiber web has been processed by both the randomizer 320' and the condensing cylinders 330' and 340' by the time it is removed by the takeoff rolls 318', the fibers in the resulting web are oriented highly isotropically, similarly to the web 1200 shown in FIG. 8.

Figure 10:
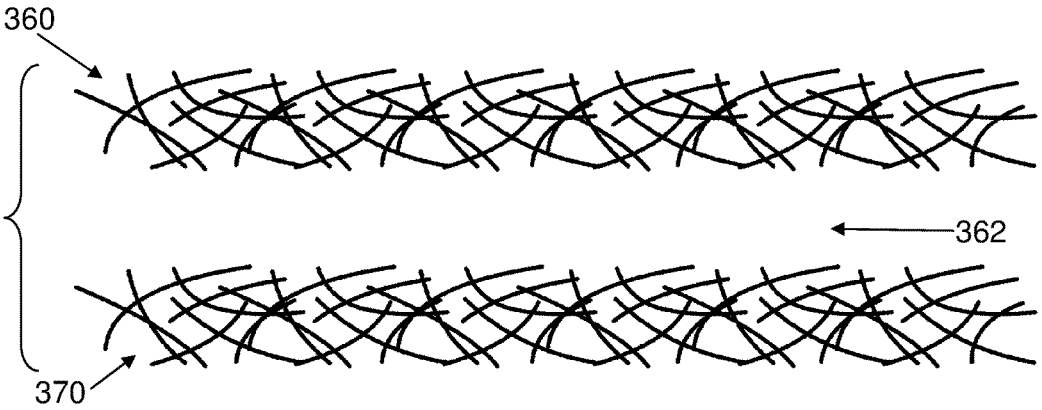
FIG. 10 is a schematic plan view illustrating two webs of non-electrostatic fibers after removal from the apparatus of FIG. 9, wherein the two webs may be highly combined, dimensionally-disordered, aerodynamic structures created on the apparatuses of FIG. 9 simultaneously.

Each of the apparatuses 350 and 350' in the FIG. 9 embodiment may produce a fiber web similar to that shown schematically in FIG. 8 and each such web may contain fibers that are randomly oriented. The FIG. 9 embodiment, which includes both apparatuses 350 and 350', may produce two substantially similar fiber webs 360 and 370, as shown in FIG. 10, simultaneously. It is contemplated that one or more additional of the apparatuses 350 and 350' can be disposed in close proximity to the main cylinder 310 and operate in the same manner as the apparatuses 350 and 350' described above. Thus, the embodiment in FIG. 9 can produce a fiber web for each such apparatus.

Figure 11:
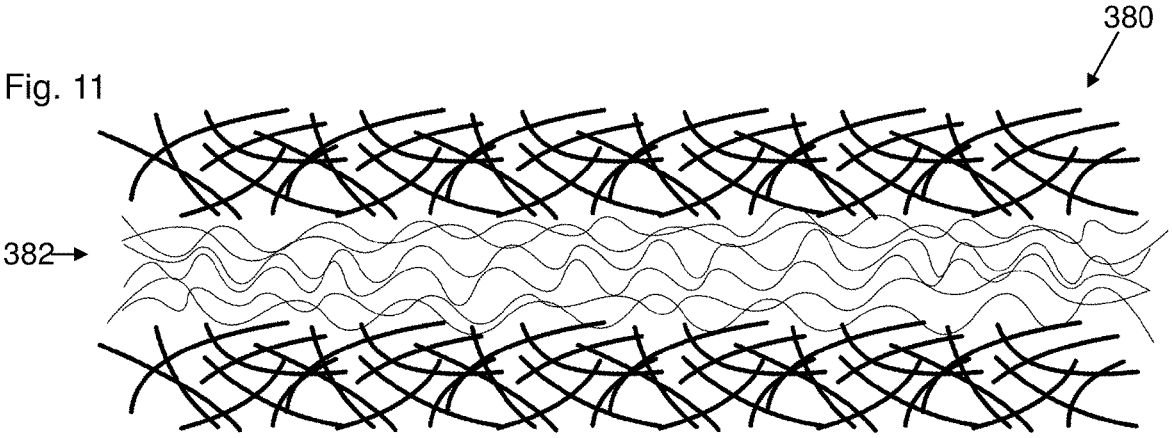
FIG. 11 is a schematic plan view illustrating a multilayer web of fibers.
Figure 12:
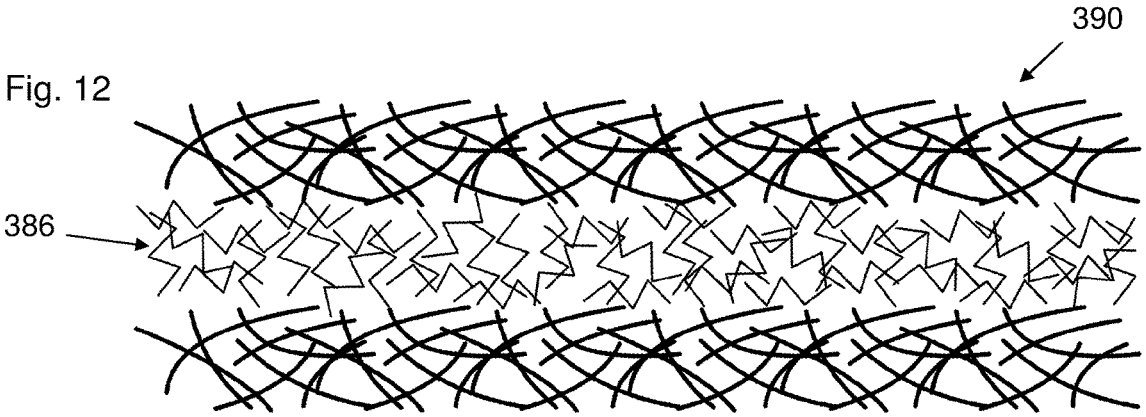
FIG. 12 is a schematic plan view illustrating another multilayer web of fibers.
Figure 13:
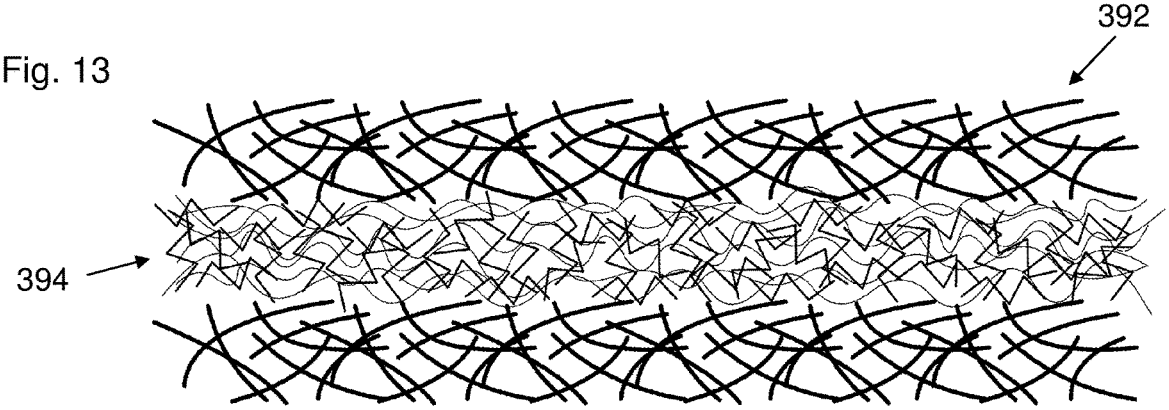
FIG. 13 is a schematic plan view illustrating still another multilayer web of fibers.

The FIG. 10 illustration shows a space 362 formed between the two non-electrostatic fiber webs 360 and 370, and that space may be maintained as the fiber webs 360 and 370 are formed and come off the apparatuses 350 and 350', or the webs 360 and 370 may be further treated before use. Thus, the space 362 may be filled with various materials subsequently, or immediately after coming off the takeoff rolls 318 and 318'. Thus, after the fiber webs 360 and 370 are formed, a layer of small fibers of micro (in the diameter range of 1-100 micrometers) and/or nano (in the diameter range of 1-100 nanometers) size may be placed in the space 362 and all such web layers may be affixed to one another in a conventional manner, such as by welding, thermal bonding, adhesives, etc. Such a composite fiber web may provide desired performance based on the content of the layer placed in the space 362, and such layer may enhance the performance of the fiber webs 360 and 370 alone. Micro fibers may have denier of 0.7 to 1.2 and fiber length is specified according to the application, but may be in the range of a few to one hundred millimeters. A preferred fiber web has 0.9 denier and 38 mm long fibers. Additives may also be included in the fiber webs 360 and 370, and/or in the layer interposed therebetween, and these include, without limitation, carbon particles, absorbent materials, adsorbent materials, desiccants, antimicrobial materials, organic and non-organic materials, and scents. As an example, the layer 382 (FIG. 11), which constitutes small denier microfibers, can be disposed in the space 362 in a conventional manner, and the multi-layered, composite fiber web 380 may be formed. As noted above, the layers of all composite webs described herein may be affixed to adjacent layers with conventional means, such as adhesives, welding, etc. As an alternative, the layer 386, which constitutes short, crimped fibers, may be disposed in the space 362 and the multi-layered fiber web 390 (FIG. 12) may be formed. Still further, the composite fiber web 392 (FIG. 13) may be formed by a composite layer 394 of short, crimped fibers and small denier microfibers in the space 362.

Figure 14:
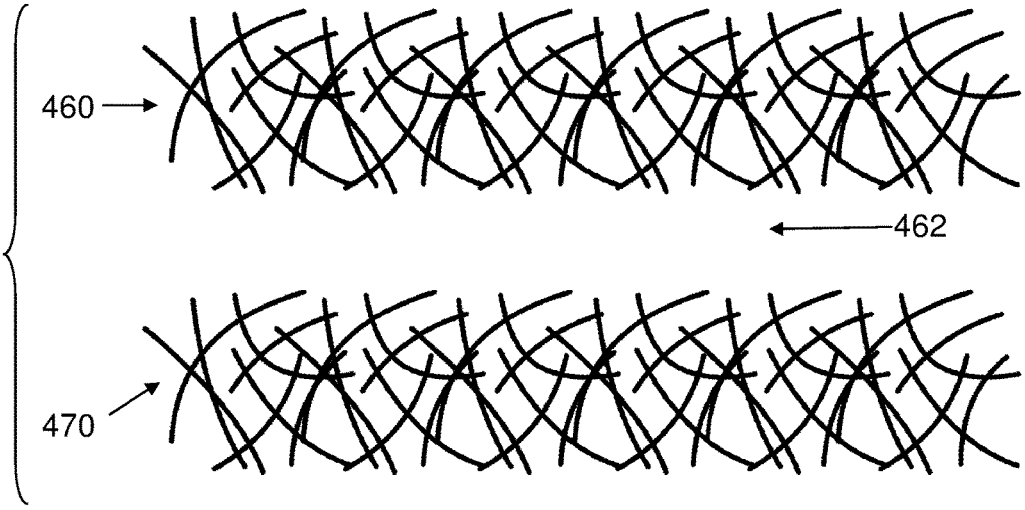
FIG. 14 is a schematic plan view illustrating two webs of electrostatic fibers after removal from the apparatus of FIG. 9, wherein the two webs are highly combined, dimensionally-disordered, aerodynamic structures created on the apparatuses of FIG. 9 simultaneously.

The apparatuses 350 and 350' in the FIG. 9 embodiment may produce two different fiber webs 460 and 470, as shown in FIG. 14. The fiber webs 460 and 470 may be different from the fiber webs 360 and 370 shown in FIG. 10, such as that they may have greater thickness, mass per unit area and/or fibers that are more transverse to the machine direction than the fiber webs 360 and 370. This may be due to the webs 460 and 470 being made of electrostatic fibers and the webs 360 and 370 being made of non-electrostatic fibers.

Figure 15:
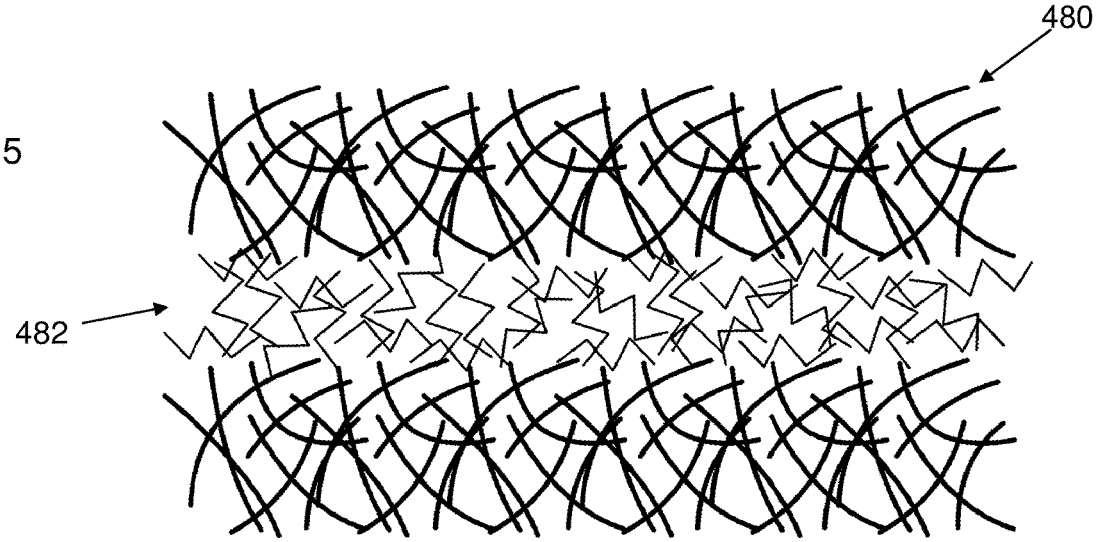
FIG. 15 is a schematic plan view illustrating another multilayer web of fibers.
Figure 16:
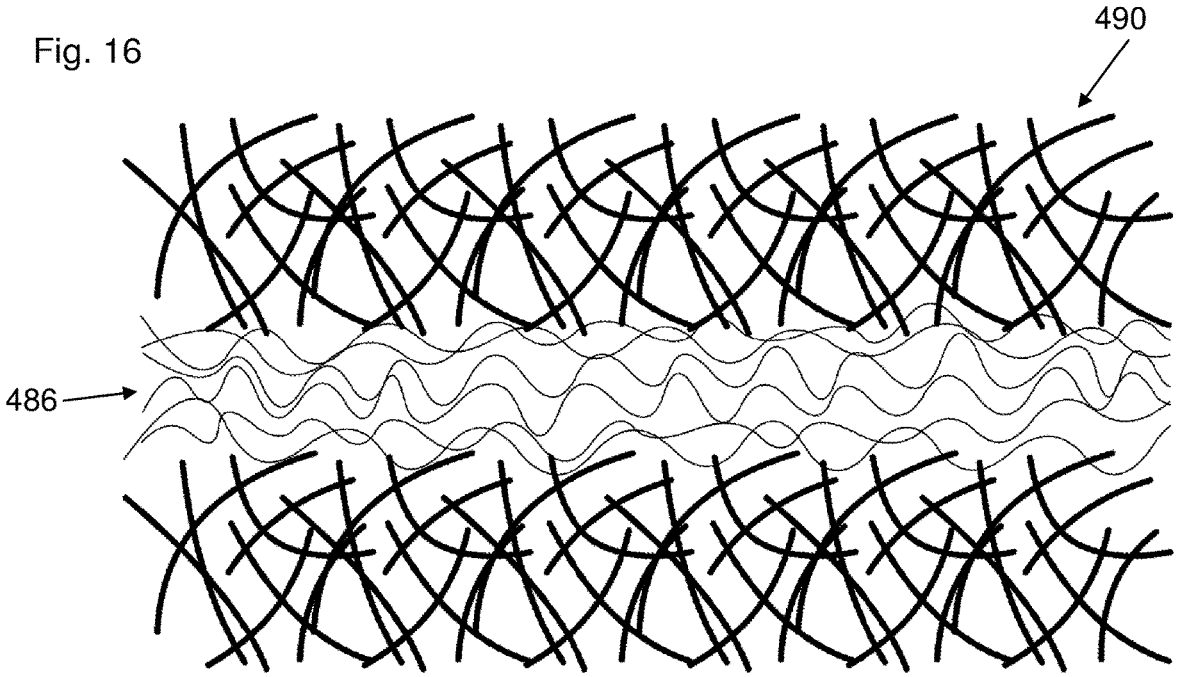
FIG. 16 is a schematic plan view illustrating still another multilayer web of fibers.
Figure 17:
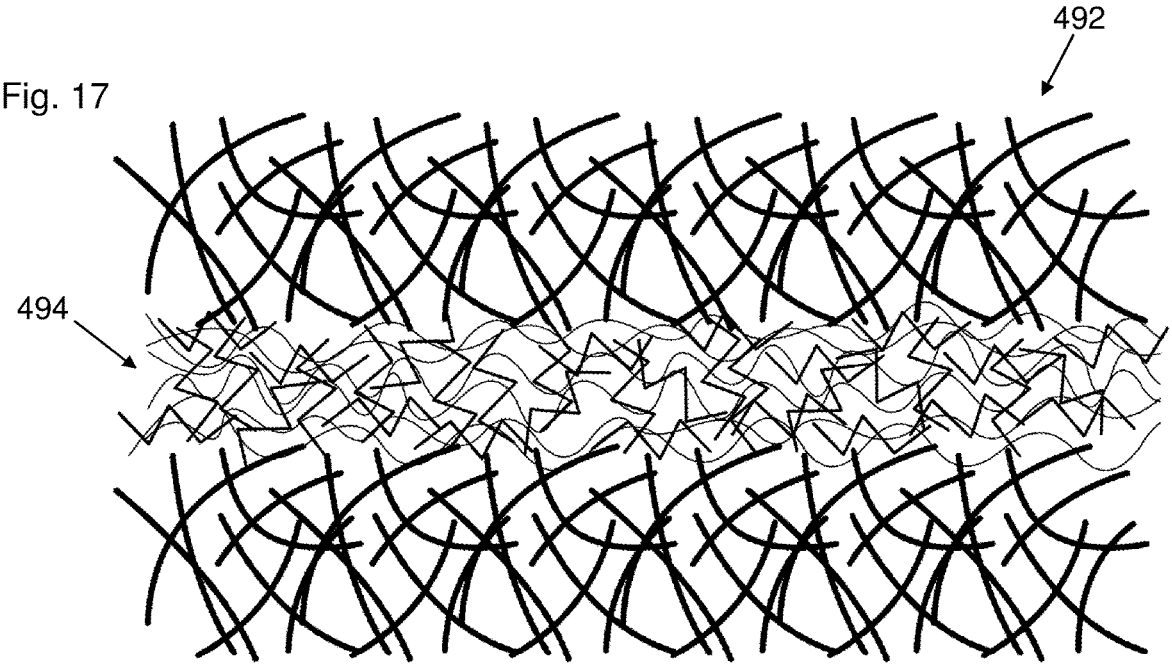
FIG. 17 is a schematic plan view illustrating yet another multilayer web of fibers.

In FIG. 14, a space 462 is formed between the electrostatic fiber webs 460 and 470, which may be maintained as the fiber webs 460 and 470 are formed and removed from the apparatuses 350 and 350'. The space 462 may be filled with various materials, as described below. For example, a layer of small fibers of micro or nano size may be placed in the space 462 and all layers may be affixed together to provide a finished web with the desired performance, and to enhance the performance of the fiber webs 460 and 470 alone. Additives may also be included in the fiber webs 460 or 470 and/or the layer interposed therebetween, and these include, but are not limited to, carbon, absorbent materials, adsorbent materials, desiccants, antimicrobial materials, and scents. As an example, the layer 482 (FIG. 15), which constitutes short, crimped fibers, can be disposed in the space 462 in a conventional manner, and the multi-layered fiber web 480 may be formed. Alternatively, the layer 486 (FIG. 16), which constitutes small denier microfibers, may be disposed in the space 462 and the multi-layered fiber web 490 may be formed. Still further, the composite fiber web 492 (FIG. 17) may be formed by a composite layer 494 of short, crimped and small denier microfibers in the space 462. Each of the interposed layers is attached to the adjacent one of the webs 460 and 470 in a conventional manner.

Figure 18:
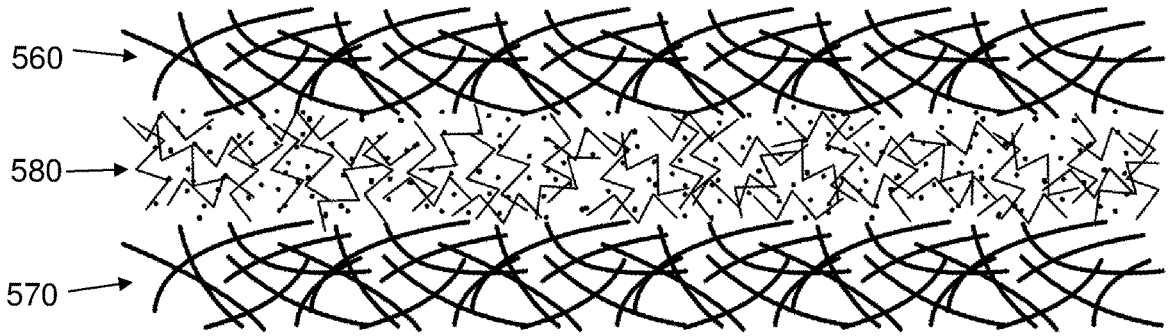
FIG. 18 is a schematic plan view illustrating even still another multilayer web of fibers.
Figure 19:
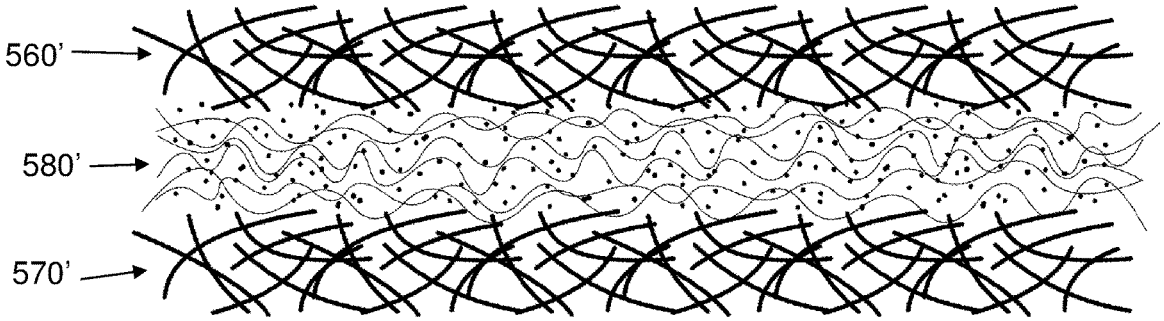
FIG. 19 is a schematic plan view illustrating another multilayer web of fibers.
Figure 20:
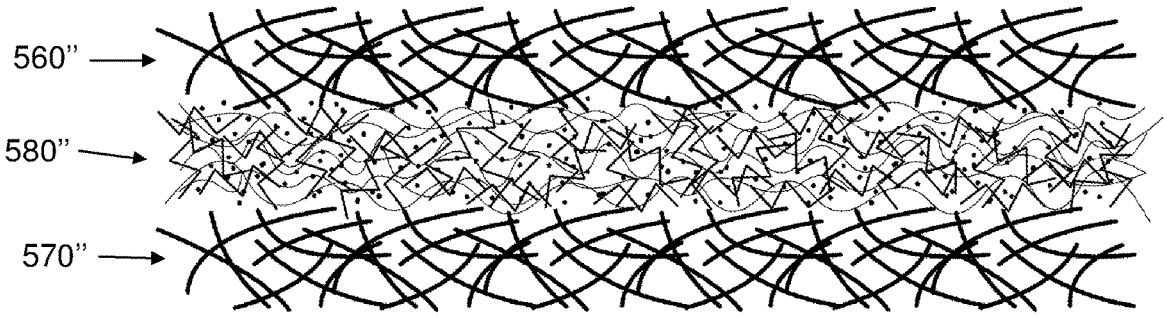
FIG. 20 is a schematic plan view illustrating still another multilayer web of fibers.

FIG. 18 shows a composite web in which two non-electrostatic fiber webs 560 and 570 sandwich a composite layer 580 of short, crimped fibers and nano fibers. FIG. 19 shows two non-electrostatic fiber webs 560' and 570' sandwiching a composite layer 580' of small denier micro fibers and nano fibers. FIG. 20 shows two non-electrostatic fiber webs 560" and 570" sandwiching a composite layer 580" of small denier micro fibers, nano fibers and short, crimped fibers.

Figure 21:
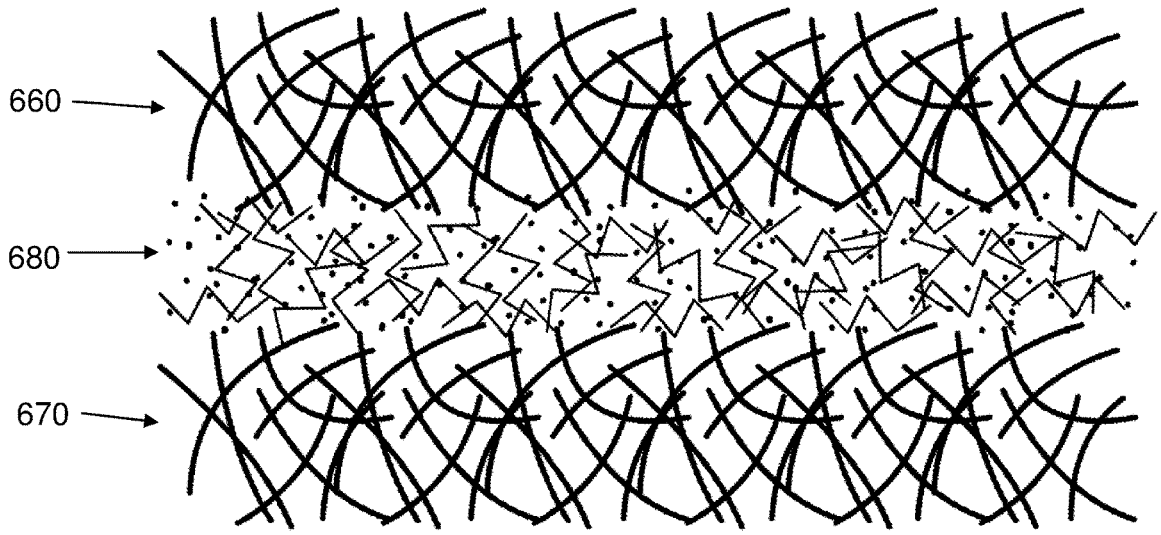
FIG. 21 is a schematic plan view illustrating yet another multilayer web of fibers.
Figure 22:
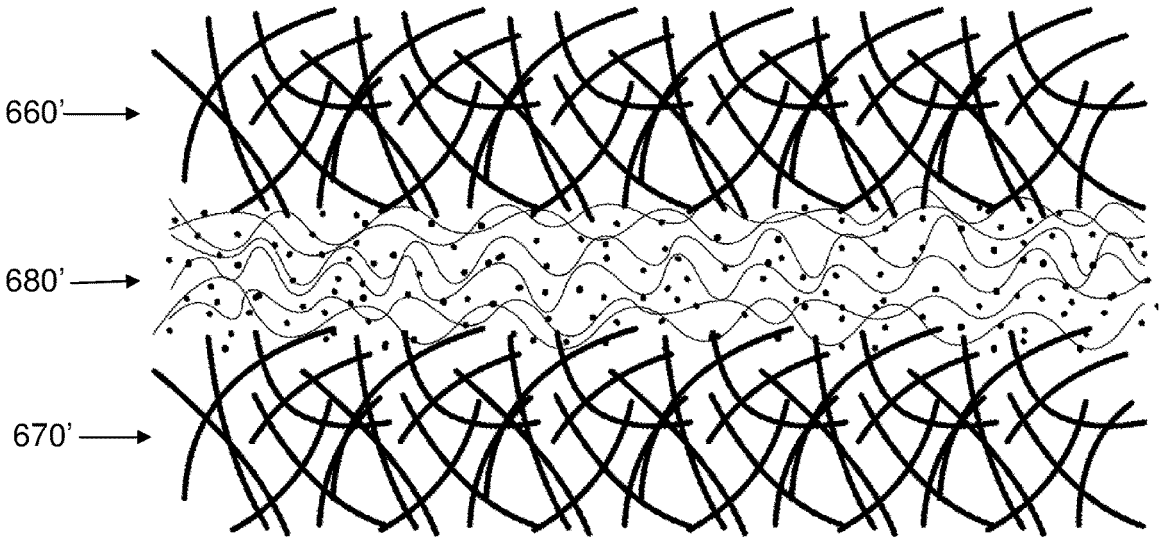
FIG. 22 is a schematic plan view illustrating even still another multilayer web of fibers.

FIG. 21 shows a composite web in which two electrostatic fiber webs 660 and 670 sandwich a composite layer 680 of short, crimped fibers and nano fibers. FIG. 22 shows two electrostatic fiber webs 660' and 670' sandwiching a composite layer 680' of small denier micro fibers and nano fibers. FIG. 23 shows two electrostatic fiber webs 660" and 670" sandwiching a composite layer 680" of small denier micro fibers, nano fibers and short, crimped fibers.

As noted above, the fiber webs formed by the apparatuses described herein can be made in layers with special fibers and additives placed between the layers to enhance even more the performance of the fiber webs. The special fibers and additives can be placed between the layers formed by the processes described above, and can also be included in the layers formed by the processes described above.

The words "three dimensional random fiber web", "complex three-dimensional geometric structures", "aerodynamic orientation", and "total randomization" are used herein. These are affected by the speeds of rotating cylinders, the shapes of the fibers, the lengths of the fibers passing through the cylinders, and/or the size (diameter and length) of the fibers, and the structure that is formed within the process.

In the processes and apparatuses described above, the random roll and the condensing rolls change the structure of the fiber web product. A web's "structure" refers to the orientation of the fibers; the way the fibers are oriented in the web relative to other fibers. The orientation of the fibers can be described with respect to one dimension, which is along the machine direction, for example in the direction of the fibers in FIG. 2. Another dimension of orientation is the direction laterally and perpendicular to the machine direction. A third dimension of fiber orientation is the direction perpendicular to the machine direction and in the direction of the web's thickness.

There is a gap between the condensing rolls that is adjusted to obtain thicker or thinner web. The isotropic structures of the webs of the disclosure help to avoid shorting and blunting of electrical flow.

Because of the way the random rolls described herein operate, the random roll allows the user to control the structure of finished webs in a manner that was not possible with prior technology. And due to the control of structure that is possible with the exemplary embodiments of the disclosure, the condensing cylinders can modify the structure of the fiber web in ways not possible with prior technology. Furthermore, the structure of the web may be modified between the condensing cylinders and/or the random roll, or both. Because one of the condensing cylinders moves faster than the other, the fibers are highly modified in the gap between the condensing cylinders from the MS to a more random orientation. When the random roll is used, the fibers are also moved in a direction different from the MD. When the random roll is combined with the condensing cylinders, the web is modified by the random roll, and then is conveyed through the gap between the condensing cylinders, and thereby the fibers are still further randomly oriented. Thus, one can use solely the random roll as in FIG. 3, solely the condensing cylinders only as in FIG. 5, or both as in FIG. 7, or multiple such combinations of any of the foregoing on the same main cylinder as in FIG. 9. When the random roll is combined with the condensing cylinders, the condensing cylinders put the "final touch" on the structure of the fiber web. Thus, the web is taken off the condensing cylinders and one can either use the web as-is, or it can be subject to further processing, such as by placing material between two layers of the web, placing additives in the web, etc.

Differences in the lengths of the fibers in a web may cause the fibers to be affected more by the random roll than by the condensing cylinders. A difference in fiber length will cause the fibers therein to be affected differently by the condensing cylinders more so than by the random roll. That is, a fiber web with a given fiber length will be modified by the condensing cylinders and by the random roll. A second fiber web with a different length fiber will be modified differently by the condensing cylinders and by the random roll, but that difference will be more pronounced in the condensing cylinders than the random roll.

The directions, speeds and protrusion shapes shown and described herein, along with the other parameters described, are not the only characteristics possible for obtaining results consistent with the disclosure. The person of ordinary skill will understand, from the description herein, that these characteristics can be modified while still carrying out the disclosure.

This detailed description in connection with the drawings is intended principally as a description of the presently preferred embodiments of the disclosure, and is not intended to represent the only form in which the present disclosure may be constructed or utilized. The description sets forth the designs, functions, means, and methods of implementing the disclosure in connection with the illustrated embodiments. It is to be understood, however, that the same or equivalent functions and features may be accomplished by different embodiments that are also intended to be encompassed within the spirit and scope of the disclosure and that various modifications may be adopted without departing from the disclosure or scope of the following claims.

The invention claimed is:

1. An apparatus for forming a web of non-woven fibers, the apparatus comprising:

(a) a main cylinder having a peripheral cylindrical surface configured to receive a plurality of fibers, the main cylinder rotating in a first rotational direction;

(b) a randomizing cylinder rotating in the first rotational direction and having a peripheral cylindrical surface adjacent the main cylinder's peripheral cylindrical surface;

(c) a doffer cylinder rotating in a second rotational direction that is opposite the first rotational direction, the doffer cylinder having a peripheral cylindrical surface adjacent the randomizing cylinder's peripheral cylindrical surface;

(d) a first condensing cylinder rotating in the first rotational direction and having a peripheral cylindrical surface adjacent the peripheral cylindrical surface of the doffer cylinder;

(e) a second condensing cylinder adjacent the first condensing cylinder and rotating in the second rotational direction, the second condensing cylinder having a peripheral cylindrical surface spaced apart from the peripheral cylindrical surface of the first condensing cylinder by a gap configured for receiving a single layer web of randomized fibers from the first condensing cylinder, the gap having a distance less than or equal to a thickness of the single layer web, wherein the peripheral cylindrical surface of the randomizing cylinder includes protrusions that extend radially at an angle of from about 30 degrees to about 60 degrees from the peripheral cylindrical surface.

2. The apparatus in accordance with claim 1, further being configured for use with synthetic fibers capable of maintaining an electrostatic charge.

3. The apparatus in accordance with claim 1, wherein the protrusions extend radially at an angle of from about 40 degrees to about 50 degrees from the peripheral cylindrical surface.

4. The apparatus in accordance with claim 3, wherein the protrusions extend radially at an angle of about 45 degrees from the peripheral cylindrical surface.

5. The apparatus in accordance with claim 1, wherein the gap has a distance less than the thickness of the single layer web, and the gap is configured to compress the single layer web upon receiving the single layer web from the first condensing cylinder.

6. The apparatus in accordance with claim 1, wherein the first and second condensing cylinders rotate at the same speed.

7. The apparatus in accordance with claim 1, wherein the first and second condensing cylinders rotate at different speeds.

8. The apparatus in accordance with claim 7, wherein the difference in speed between the first and second condensing cylinders is about 2 to 20 percent.

9. A method for forming a web of non-woven fibers, the method comprising:

(a) disposing a plurality of fibers on a peripheral cylindrical surface of a main cylinder, the main cylinder rotating in a first rotational direction;

(b) rotating a randomizing cylinder in the first rotational direction, the randomizing cylinder having a peripheral cylindrical surface adjacent the main cylinder's peripheral cylindrical surface, the randomizing cylinder's peripheral cylindrical surface removing at least some of said plurality of fibers from the main cylinder; and (c) rotating a doffer cylinder in a second rotational direction, which is opposite the first rotational direction, the doffer cylinder having a peripheral cylindrical surface adjacent the randomizing cylinder's peripheral cylindrical surface, the doffer cylinder's peripheral cylindrical surface removing at least some of said plurality of fibers from the randomizing cylinder;

(d) rotating a first condensing cylinder in the first rotational direction, the first condenser cylinder having a peripheral cylindrical surface adjacent the peripheral cylindrical surface of the doffer cylinder, the first condensing cylinder's peripheral cylindrical surface removing at least some of said plurality of fibers from the doffer cylinder; and (e) rotating a second condensing cylinder in the second rotational direction, the second condensing cylinder being adjacent the first condensing cylinder and having a peripheral cylindrical surface spaced apart from the peripheral cylindrical surface of the first condensing cylinder by a gap configured for receiving a single layer web of randomized fibers from the first condensing cylinder, the gap having a distance less than or equal to a thickness of the single layer web;

wherein the peripheral cylindrical surface of the randomizing cylinder includes protrusions that extend radially at an angle of from about 30 degrees to about 60 degrees from the peripheral cylindrical surface.

10. The method in accordance with claim 9, wherein the protrusions extend radially at an angle of from about 40 degrees to about 50 degrees from the peripheral cylindrical surface.

11. The method in accordance with claim 10, wherein the protrusions extend radially at an angle of about 45 degrees from the peripheral cylindrical surface.

12. The method in accordance with claim 9, wherein the gap has a distance less than the thickness of the single layer web, and further including the step of compressing the single layer web in the gap.

13. The method in accordance with claim 9, further including rotating the first and second condensing cylinders at the same speed.

14. The method in accordance with claim 9, further including rotating the first and second condensing cylinders at different speeds.

15. The method in accordance with claim 14, wherein the difference in speed between the first and second condensing cylinders is about 2 to 20 percent.

* * * * *